US006509873B1

(12) United States Patent
Nalbandian et al.

(10) Patent No.: US 6,509,873 B1
(45) Date of Patent: Jan. 21, 2003

(54) CIRCULARLY POLARIZED WIDEBAND AND TRAVELING-WAVE MICROSTRIP ANTENNA

(75) Inventors: Vahakn Nalbandian, Ocean, NJ (US); Choon S. Lee, Dallas, TX (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 28 days.

(21) Appl. No.: 09/688,419

(22) Filed: Oct. 16, 2000

Related U.S. Application Data

(63) Continuation-in-part of application No. 09/204,045, filed on Dec. 2, 1998, now abandoned.

(51) Int. Cl.[7] ..... H01Q 1/36

(52) U.S. Cl. ..... 343/700 MS; 343/731; 343/769

(58) Field of Search ..... 343/700 MS, 769, 343/731, 831, 846; H01Q 1/36

(56) References Cited

U.S. PATENT DOCUMENTS 4,564,842 A * 1/1986 Suzuki ..... 343/700 MS
5,448,252 A * 9/1995 Ali et al. ..... 343/700 MS
5,818,391 A * 10/1998 Lee ..... 343/700 MS

* cited by examiner

*Primary Examiner*—Michael C. Wilmer
(74) *Attorney, Agent, or Firm*—Michael Zelenka; George B. Tereschuk

(57) ABSTRACT

The present invention is an antenna comprising a microstrip having upper and lower layers for producing leaky wave radiation. Circularly shaped patches are located on the two layers for circularly polarizing the leaky wave radiation. The present invention provides a microstrip antenna that can produce wideband, circularly polarized radiation. The antenna, therefore, is a compact, low cost, rugged, conformal, planar, and circularly polarized microstrip antenna. The antenna combines the advantages of wideband circularly polarized radiation with the advantages of lightweight, low profile, low cost, and planar microstrip antennas.

22 Claims, 4 Drawing Sheets

CIRCULARLY POLARIZED WIDEBAND AND TRAVELING-WAVE MICROSTRIP ANTENNA

CONTINUATION-IN-PART

This application is a Continuation-In-Part of U.S. Patent Office application Ser. No. 09/204,045, entitled "Circularly Polarized Traveling-Wave Microstrip Antenna," which was filed on Dec. 2, 1998, by the same inventors herein, now abandoned. This Continuation-In-Part is being filed under 35 USC §120 and 37 CFR §1.53 and priority from that application is claimed.

GOVERNMENT INTEREST

The invention described herein may be manufactured, used, imported, sold, and licensed by or for the Government of The United States of America without the payment to us of any royalty thereon.

BACKGROUND OF THE INVENTION

1. Field of the Invention.

The invention generally relates to circularly polarized antennas. In particular, the invention relates to wide band, low cost, planar, circularly polarized microstrip antennas.

2. Discussion of the Background.

Mobile systems need circularly polarized radiation. When a transmitter and receiver are stationary, the transmitter and receiver can be aligned, so that only linearly polarized radiation is necessary. However, when an airplane is in flight, or a satellite is in orbit, the airplane or satellite will not be able to detect radiation from a transmitter if the receiving antenna is not aligned with the radiation. Therefore, many commercial and military systems need circularly polarized antennas. In addition to being circularly polarized, these antennas need to be compact, low cost, rugged, and have a wide bandwidth. The systems that use these antennas include aircraft and space systems, electronic support systems, and communications systems.

Presently, spiral antennas are used for producing wideband circularly polarized (CP) radiation. However, spiral antennas have limited applications, because the structure of spiral antennas has co-planar metallic strips. There are two problems with using co-planar metallic strips to form an antenna.

First, the radiation from the antenna is bi-directional because of the co-planar structure. Accordingly, the strong radiation to the back side of the antenna plane must be reduced significantly. The resultant structure with reduced back radiation is bulky, large, and has degraded performance. Second, the co-planar metallic strips reduce the power handling capacity of the antenna because of high fringe radiation fields at the feed junction to the antenna.

Clearly, spiral antennas meet the need of circular polarization with a wide bandwidth, but fail miserably in providing an antenna that is compact, low cost, rugged and conformal, with a high power handling capacity. Therefore, there is a long-felt need in this field for a circularly polarized antenna that does not have the bulky size, degraded performance, or reduced power handling capacity of spiral antennas, but instead is compact, low cost, rugged, and has a high power handling capacity.

Microstrip antennas are an excellent improvement over large and bulky antennas, such as co-planar spiral antennas. Microstrip antennas are lightweight and low cost, and have a low profile because they are planar. Microstrip antennas overcome many of the problems associated with bulky antennas. However, prior art microstrip antennas have long suffered from an inherently narrow bandwidth, typically less than 1% for circularly polarized radiation. Prior art resonant or standing wave microstrip antennas provide about a 3% bandwidth for a linearly polarized antennas and only about 1% bandwidth for circularly polarized antennas. This limitation makes microstrip antennas useless for applications that require wideband circularly polarized radiation. In circularly polarized radiation, a circularly polarized radiation within 6 dB of all polarizations, which is provided by this invention's antenna, is considered a good CP frequency bandwidth.

The present invention overcomes the long-standing bandwidth limitations of prior art microstrip antennas by providing a circularly polarized leaky-wave wideband traveling wave antenna that provides better than an 11%, 6 dB frequency bandwidth with only a single RF input. These significant differences in bandwidth results are compared in TABLE I below.

TABLE I

FREQUENCY BANDWIDTHS OF COMPACT CONFORMAL MICROSTRIP ANTENNAS

| MICROSTRIP ANTENNA TYPE | LINEARLY POLARIZED BANDWIDTH | CIRCULARLY POLARIZED BANDWIDTH |
|---|---|---|
| Prior Art Standing wave/ resonant structure | 3% | 1% |
| Leaky Wave Wideband Traveling Wave with 2.2 dielectric constant | 35% | 11% |
| Leaky Wave Wideband Traveling Wave with 1.1 dielectric constant | 104% | 35% (est.) |

TABLE I also shows other bandwidth results based on different dielectric constants, including this invention's leaky wave wideband traveling-wave microstrip antenna achieving more than a 20% wide frequency bandwidth when materials with a lower dielectric constant of about 1.1 is employed instead of a 2.2 dielectric constant. TABLE I demonstrates that this invention's dramatic bandwidth improvement can satisfy the strong need in this field for a microstrip antenna that can radiate wideband, circularly polarized radiation, and thereby overcome the drawbacks, disadvantages and limitations of prior art narrow bandwidth microstrip antennas.

This invention's circularly polarized leaky-wave wideband traveling wave antenna also differs from prior art circularly polarized microstrip antennas that split the RF energy into two and use two separate SMA connectors, by advantageously employing an innovative single feed, which is more efficient than the split RF energy technique because it eliminates the extra circuitry needed for the splitting technique, and the associated weight and costs. The prior art splitting technique does not operate in wide bandwidth antennas, because a delay line producing the required 90 degrees phase shift for CP radiation at the highest frequency of the bandwidth might produce only 60 degrees at the lower frequency.

Not only does this invention provide a substantial improvement in bandwidth capacity, but the circularly polarized microstrip antenna of this invention is also significantly different from prior art microstrip antennas that are either circularly shaped or include a circular array of microstrip antennas. Further, this invention's antenna is thin and its linear dimension is approximately equal to one wavelength, making it more compact than prior art wideband antennas. Additionally, the present invention provides a circularly polarized leaky-wave wideband traveling wave antenna based on the traveling wave principle, which is completely different from the standing wave technique utilized in prior art compact microstrip antennas.

The present invention provides a microstrip antenna that can produce wideband, circularly polarized radiation. The present invention, therefore, is a compact, low cost. rugged, conformal, planar, and circularly polarized microstrip antenna. The present invention eliminates the bulky size and reduced power handling capability found in spiral circularly polarized antennas. The present invention eliminates the narrow bandwidth that is inherent to microstrip antennas. The present invention combines the advantages of wideband circularly polarized radiation with the advantages of lightweight, low profile, low cost, and planar microstrip antennas. Compared with other leaky wave antennas, the present invention is planar and is easily implemented in an MMIC (monolithic microwave integrated circuit) environment.

SUMMARY OF THE INVENTION

The present invention is an antenna comprising means for producing leaky wave radiation and means for circularly polarizing the leaky wave radiation. In another embodiment, the invention is a method of producing a circularly polarized wide band traveling wave from a microstrip antenna. In a further embodiment, the invention is a circularly polarized wide band traveling wave formed by producing leaky wave radiation and circularly polarizing the leaky wave radiation.

BRIEF DESCRIPTION OF THE DRAWINGS

TABLE I illustrates frequency bandwidths of compact conformal microstrip antennas.

DETAILED DESCRIPTION OF THE INVENTION

Figure 1A:
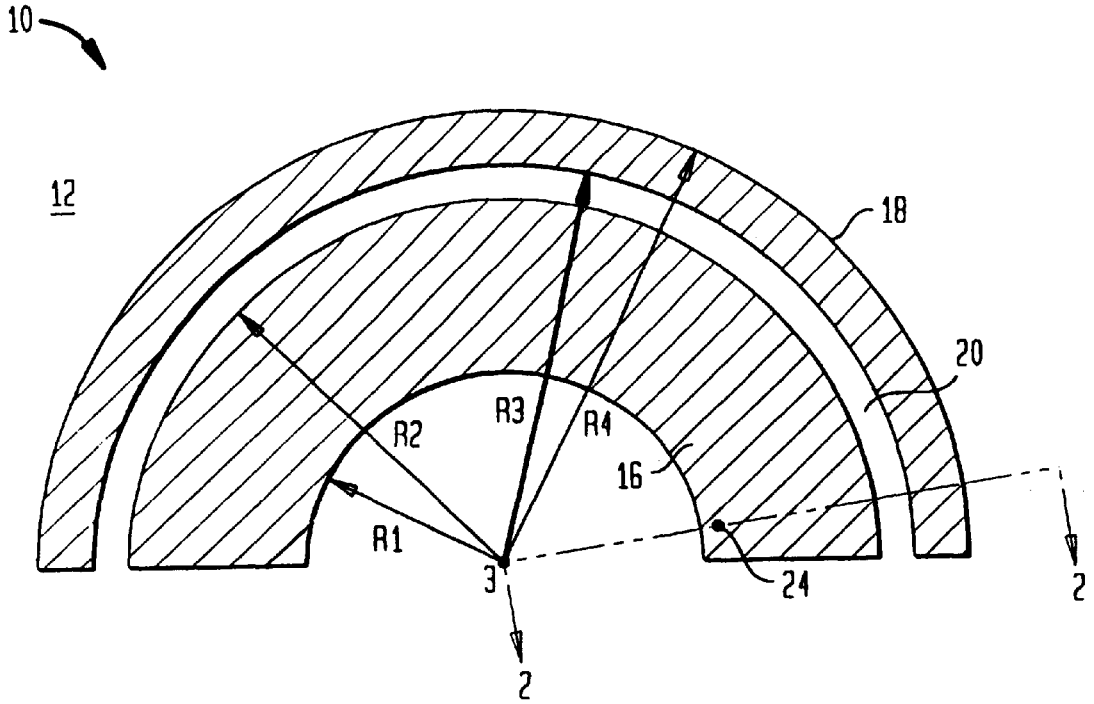
FIG. 1 shows the top and bottom sides of the circularly polarized traveling-wave microstrip antenna.
Figure 1B:
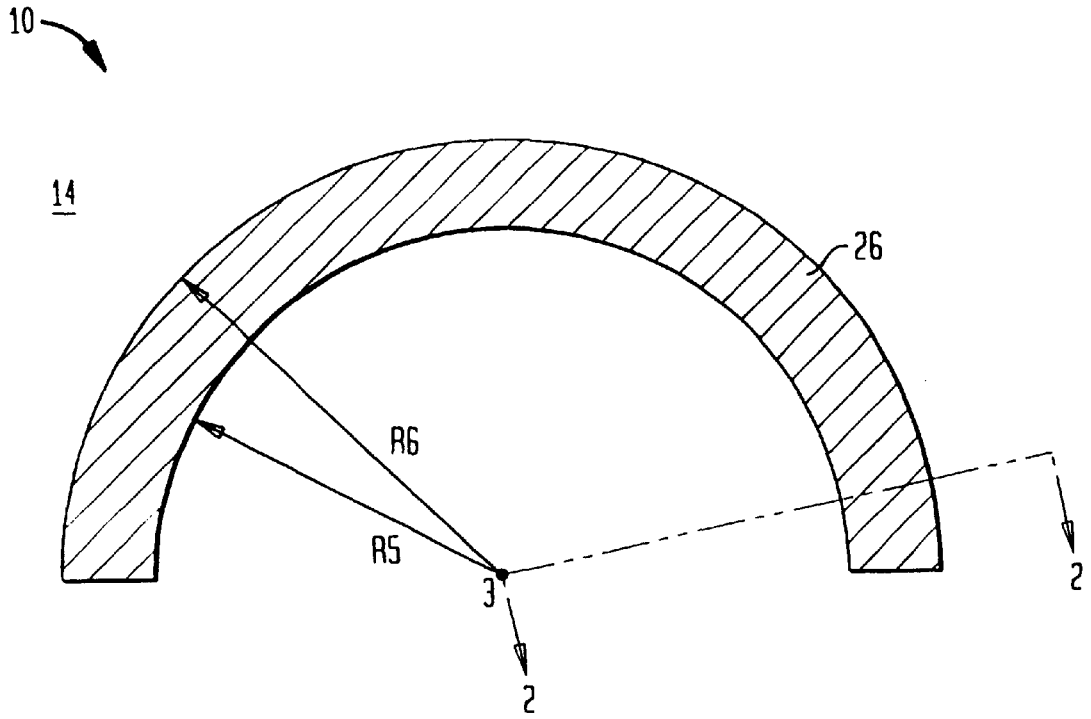

FIGS. 1A and 1B illustrate the antenna 10 of the present invention.

The antenna 10 has a lower dielectric layer 12 as shown in FIG. 1A . FIG. 1A shows a first conductive patch 16 and a second conductive patch 18 placed on the lower layer 12. A gap 20 separates the first patch 16 and the second patch 18. Radius R1 is the inner radius of patch 16. Radius R2 is the outer radius of patch 16. Radius R3 is the inner radius of patch 18, and radius R4 is the outer radius of patch 18.

A coaxial probe 24, which may be an SMA connector, is coupled to the first patch 16. Coaxial probe 24 provides electromagnetic energy, preferably in a microwave frequency range, to the leaky wave antenna 10. The coaxial probe is positioned along the direction perpendicular to the direction of propagation. The coaxial feed may have an impedance of 50 Ohms. This invention's single coaxial probe 24 differs from those prior art circularly polarized antennas that generate circular polarization in microstrip antennas by splitting the RF energy into two and then delaying one section 90 degrees out of phase with a fixed delay line and feeding the split RF energy into the antenna by using two separate SMA connectors. The antenna 10 has an upper dielectric layer 14 as shown in FIG. 1B. FIG. 1B shows a conductive coupling patch 26 placed on the upper layer 14. This coupling patch 26 is located over the gap 20 as shown in FIG. 2, and covers the entire width of the gap 20.

Figure 2:
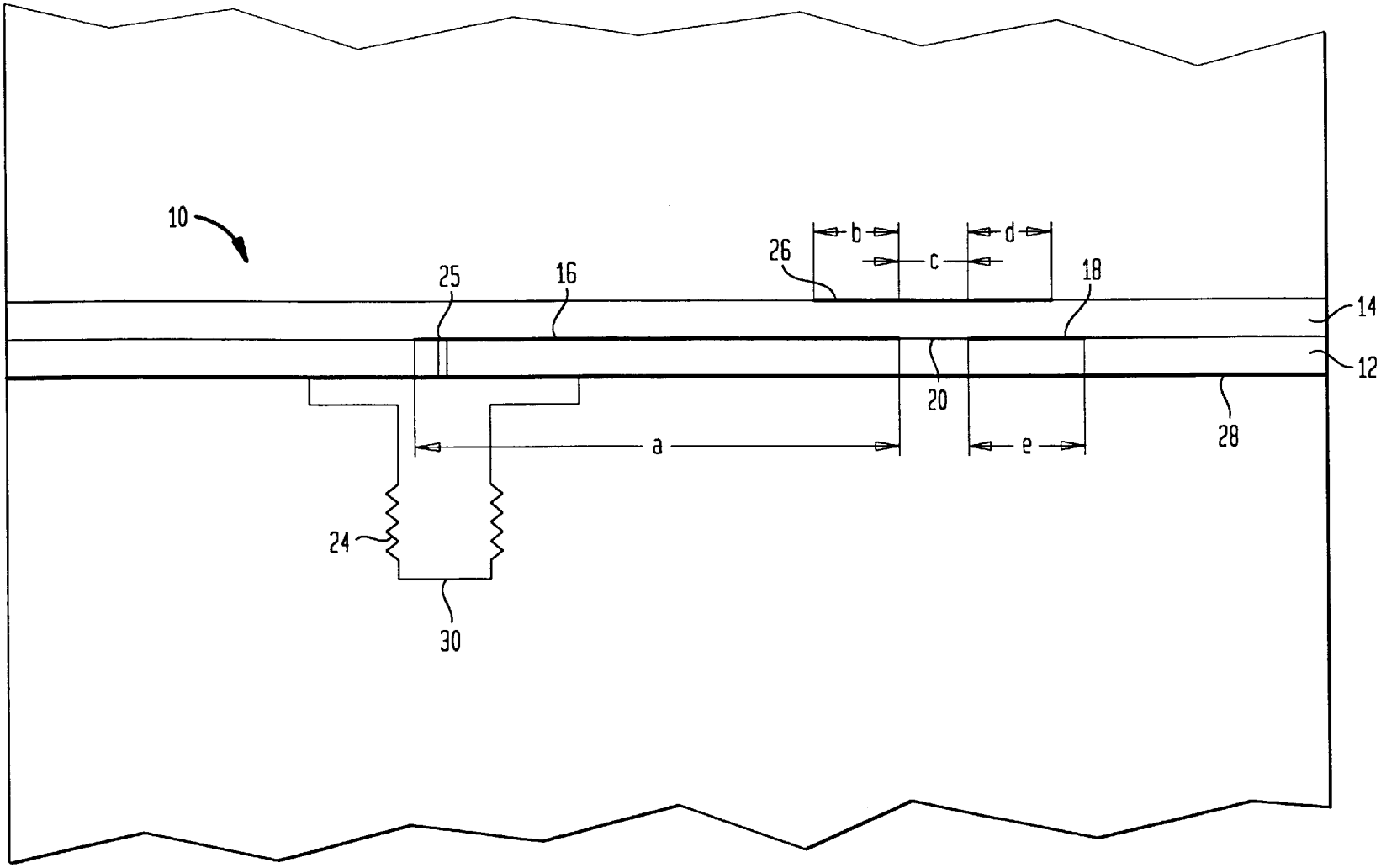
FIG. 2 shows the side view of the circularly polarized traveling-wave microstrip antenna.

FIG. 2 is a side view of the present invention 10. The lower layer 12 is a dielectric material that may be made of Duroid with a dielectric constant of approximately 2.2. However, other dielectric materials and different dielectric constants may be used. Placed on the planar surface of the lower dielectric 12 is a conductive ground plane 28. The ground plane 28 may be made of any conductive material, such as silver or copper.

The first patch 16 and the second patch 18 are formed of a conductive material such as copper or silver, on the opposing planar surface of the lower layer 12. The patches 16 and 18 are positioned so that a gap 20 is formed there between. The coaxial probe 24 with conductor 30, is coupled to the first patch 16 and the lower dielectric layer 12 through center pin 25.

An upper dielectric layer 14 is positioned above the first and second patches 16 and 18, thereby bridging the gap 20. An upper coupling patch 26, which may be made of any conductive material, such as copper or silver, is placed on the opposing planar surface of upper layer 14. The coupling patch 26 is positioned over the gap 20 and covers a portion of the first patch 16 and a portion of the second patch 18. The patches 16, 18, 26 may be formed on the dielectric layers 12 and 14 by any conventional means, such as deposition or etching, or may be attached with an adhesive.

Referring to FIG. 2, distance a represents the lateral distance of first patch 16. Distance b represents the lateral distance over which coupling patch 26 overlays first patch 16. Distance c represents the lateral distance of gap 20 between the first patch 16 and the second patch 18. Distance d represents the lateral distance over which coupling patch 26 overlays second patch 18. Distance e represents the lateral distance of second patch 18.

Figure 3:
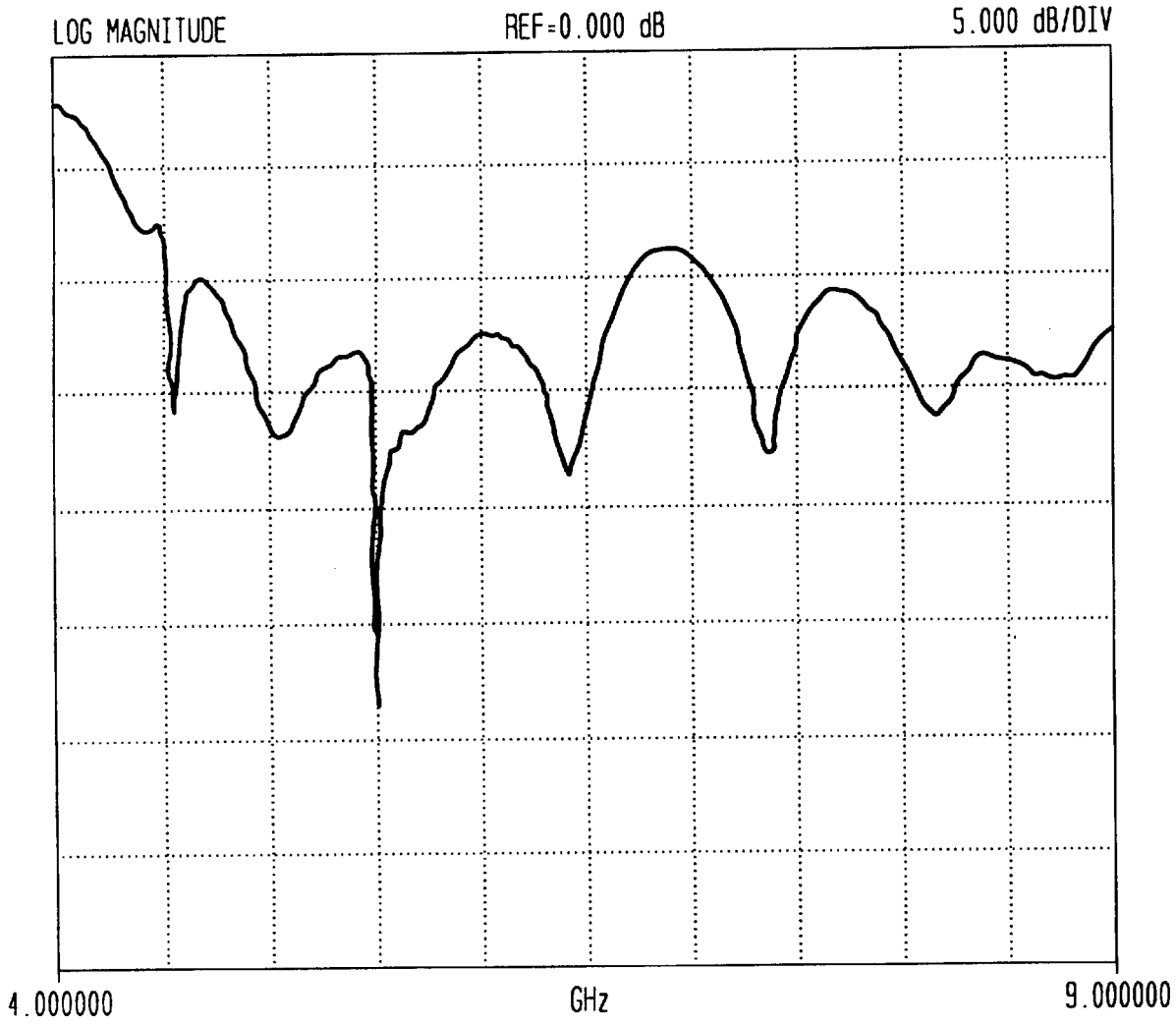
FIG. 3 shows the return loss as a function of frequency for the antenna of FIGS. 1 and 2.

FIG. 3 is a graph illustrating the return loss as a function of frequency for a particular embodiment of the present invention. The X axis represents frequency in GHz and the Y axis represents magnitude in decibels.

In this embodiment, with reference to FIG. 2, distance a was 0.8 inch, b was 0.133 inch, c was 0.1 inch and e was 0.133 inch. Referring to FIG. 1A, radius R1 was 0.6 inch, R2 was 1.4 inches, R3 was 1.5 inches and R4 was 1.7 inches. Referring to FIG. R5 was 1.267 inches and R6 was 1.633 inches.

Copper foil was used for the conductive patches and had a thickness of 1.4 mil or approximately 0.04 millimeters. The Duroid layers of antenna 10 were 62 mils thick, and were thermally bonded by using 1.5 mil thick bonding film. The RF feed location was optimized along with the direction perpendicular to the direction of propagation, the center pin of the 50 Ohm connector was soldered to the mid-layer copper near the corner and 50 mils from each edge.

The Operation of the Present Invention

The operation of the present invention is readily appreciated. First, the present invention uses a "leaky wave" design to produce wideband radiation. Second, the present invention uses circular patches placed on the microstrip for producing circularly polarized (CP) radiation. Therefore, the present invention is a leaky wave, circularly polarized microstrip antenna.

1. Leaky Wave Radiation

A solution to the problems caused by the co-planar structure of previous antennas uses a microstrip structure backed by a ground plane. However, in a microstrip structure, the dominant mode is the "quasi" TEM mode, which is a surface mode and does not radiate. Therefore, a microstripline excited by a "quasi" TEM mode will produce very little radiation, even when the striplines are highly curved. The higher order modes, however, become "leaky," or radiate energy, when the propagation constant of the microstrip is less than that of the free space wave number $k_0$. One simple way to create leaky wave radiation is to excite a microstripline by using a coaxial probe.

The cutoff frequencies for this leaky mode are obtained by solving an equation that assumes no field variation along the longitudinal direction. Assuming the attenuation constant is relatively small, the real part of the propagation constant is approximately given by:

$$\beta=\sqrt{\epsilon_{r}k_{0}^{2}-k_{x}}$$

Where $k_0$ is the free space wave number, $k_X$ is the wave vector component in the direction perpendicular to the wave propagation, and $\epsilon_r$ is the dielectric constant of the substrate. Then we can obtain the frequency range within which the mode becomes leaky.

When the operating frequency is less than the cutoff frequency, $f_C$, the wave becomes evanescent. On the other hand, if the propagation constant is larger than $k_O$, the mode becomes a surface wave, which propagates without any radiation. Thus, the frequency range for the leaky-wave mode of operation is given by:

$$f_c < f < \frac{f_c\sqrt{\varepsilon_r}}{\sqrt{\varepsilon_r - 1}}$$

Significantly, it is noted that the bandwidth increases drastically as the dielectric constant becomes close to one.

However, there are two major obstacles to achieving leaky wave radiation from this type of antenna. First, the input impedance of the feed must match the field strength at the feed location. Second, radiation caused by surface mode excitations must be prevented and suppressed.

The present invention overcomes these obstacles by using a high order mode so that the radiation level from the antenna will be much stronger than the "quasi" TEM radiation levels. The radiation level and the input impedance of the present invention are controlled by a double layer structure 10. The field strength at the feed location is altered to match the input impedance. This is done by varying the locations and the widths of the metallic patches 16, 18, and 26 on the two layers 12 and 14 until the field strength at the feed location matches the input impedance at the feed. In other words, the input impedance of the antenna matches the leaky wave propagation mode of the radiation. Consequently, the antenna radiates a "leaky wave."

Once the input impedance is matched to a particular leaky wave mode of propagation, the surface modes are automatically suppressed due to the difference between the impedance of the surface and leaky waves. Therefore, the surface modes will not be excited, because of the impedance mismatch to all the modes other than the intended leaky mode. The use of the leaky-wave structure is a significant difference between the circularly polarized microstrip antenna of this invention and the prior art resonant structure, including microstrip antennas with a circularly shape or a circular array of microstrip antennas.

2. Circularly Polarized Radiation

There are two requirements for producing circularly polarized radiation. First, two radiating sources must produce radiation fields perpendicular to each other with nearly equal magnitudes. Second, the field components of these two sources have to be 90 degrees out of phase. These two conditions are met when the double layer striplines are circularly curved as shown in FIG. 1.

The patches 16, 18 and 26 on the two layers 12 and 14 of the microstrip 10 are circular in shape. The shape of the patches can range from one quarter of a circle to a full circle. The patches are located on a circumference of a circle having a center 3 and a radius equal to at least one of the radii R1, R2, R3, R4, R5 and R6 of the patches, as shown in FIG. 1. When the traveling wave propagates along the patches 16, 18 and 28, around the circumference of the circle a quarter turn (90 degrees), the radiation source is rotated by 90 degrees. This satisfies the first requirement for producing circularly polarized radiation.

When the radii of the circular microstrip patches 16, 18 and 26 are properly chosen, the phase shift of 90 degrees can be achieved due to the phase change of the leaky wave along the propagation path. In other words, when a distance of a quarter turn (90 degrees) of the microstrip patches equals one quarter of the wavelength of the radiation propagating in the dielectric microstrip, the second CP requirement of 90 degree phase difference is achieved.

The antenna of the present invention is shown in FIG. 1, where the shape of a half circle is illustrated. The lower layer 12 is fed by a coaxial probe 24 through center pin 25, and the upper layer 14 is electromagnetically coupled to lower layer 12 through coupling patch 26, which is above a long narrow gap 20 in between patches 16 and 18. The antenna of FIG. 1 can be shaped to form a fuller circle, which will give better results. However, the fuller circular shape will increase the size of the antenna.

3. Experimental Results.

FIG. 3 shows the return-loss measurements of the antenna shown in FIGS. 1 and 2. The frequency at which the return-loss abruptly drops is the cutoff frequency of the lowest order leaky mode. The measured cutoff frequency was about the same as the computed cutoff frequency of 4.36 GHz. The return-loss measurements show an excellent impedance match over a wide frequency range above the cutoff frequency.

The input impedance is matched to the field strength at the feed location by varying the widths and locations of the metallic strips 16, 18 and 26, which consequently adjusts the field strength at the feed point. At low frequencies, most of the input power is reflected, because the input impedance is matched only to a leaky mode which is not propagating. At high frequencies, the lowest-order leaky mode becomes a surface mode and most of the power is transmitted.

For the leaky-mode propagation, the operating frequency must be above the cutoff frequency. After a quarter turn along the patches 16, 18 and 26 in the microstrip 10, the fields at the radiating edges become perpendicular to those at the beginning. While propagating, the wave leaks its power and adds the phase progression to the radiated fields depending on the propagation length and the waveguide wavelength.

When the wave propagates along the innermost radiating edge, the operating frequency must be around 4.50 GHz in order to satisfy the CP phase requirement after a quarter turn.

When the wave propagates along the outermost edge, the frequency must be approximately 5.37 GHz to satisfy the phase requirement. Thus, the optimum frequency is between these two frequencies. The antenna 10 radiates efficiently between those two frequencies, resulting in a wideband traveling wave antenna.

Indeed, a good CP radiation was observed between 4.4 and 4.9 GHz, giving an 11 percent, 6-dB bandwidth. This bandwidth is much larger than the CP bandwidth of a typical standing wave antenna with a single feed, which is about 1%. The frequency bandwidth of a linear structure (for linear polarization) made of dielectric material with a relative dielectric constant of 2.2 is 35 percent. This invention's circularly polarized wideband traveling-wave microstrip antenna could achieve a more than 20% wide frequency bandwidth. However, at this point the circular polarized radiation can deteriorate to approach linear polarization. Referring back to TABLE I, this invention's leaky wave wideband traveling-wave microstrip antenna can achieve a 20% wide frequency bandwidth when materials with a lower 1.1 dielectric constant is employed instead of a 2.2 dielectric constant, and thereby overcome the drawbacks, disadvantages and limitations of prior art narrow bandwidth microstrip antennas.

Figure 4:
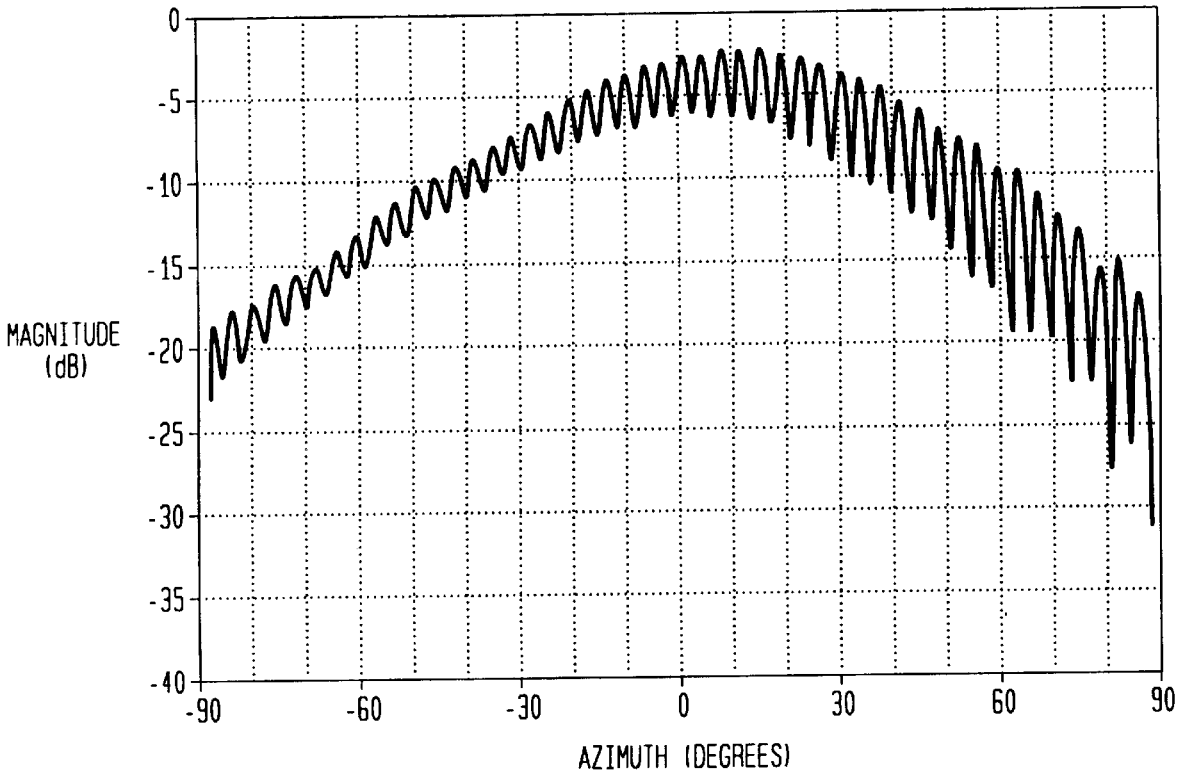
FIG. 4 shows the radiation pattern as the linearly polarized reference horn antenna rotates.

FIG. 4 shows the measured radiation pattern taken with a rotating linearly polarized receiving antenna. This pattern shows good circular polarization near the maximum radiation direction.

With modified geometries of this invention's antenna, the CP bandwidth and the radiation quality can be increased.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components and dimensions can achieve the results described herein, without departing from the spirit and scope of this invention. Accordingly, the present invention should not be limited by the foregoing description, but only by the appended claims.

What we claim is:

1. A method of producing a circularly polarized wideband traveling wave from a compact, lightweight, planar microstrip antenna for a mobile communications platform, comprising the steps of:

forming a microstrip with an upper dielectric layer and a lower dielectric layer;

shaping a first conductive patch and a second conductive patch to be circularly curved;

disposing said first conductive patch and said second conductive patch on said lower dielectric layer;

separating said first conductive patch and said second conductive patch by a gap;

disposing a conductive ground plane on a planar surface of said lower dielectric layer;

covering said gap by placing a circularly curved coupling patch on said upper dielectric layer;

electro-magnetically coupling a single coaxial feed probe to said first patch and said lower dielectric layer in a direction perpendicular to a direction of propagation across said lower dielectric layer;

exciting said microstrip to produce a leaky wave radiation;

circularly polarizing the leaky wave radiation;

the circularly polarizing step further comprising the steps of:

producing two perpendicular, radiating fields; and shifting the phase of at least one of the fields until the two fields are 90 degrees out of phase;

controlling an antenna radiation level and an input impedance of said antenna by said upper dielectric layer and said lower dielectric layer causing said input impedance to match a leaky wave propagation mode of said leaky wave radiation;

positioning said first, second and coupling patches on said layers causing an alteration of a field strength at said single coaxial probe resulting in said field strength matching said input impedance at said single coaxial probe; and aligning said first, second and coupling patches to circularly polarize the leaky wave radiation when a traveling wave propagates along said first, second and coupling patches;

wherein the step of producing two perpendicular, radiating fields comprises propagating a traveling wave from one of the radiating fields along one quarter of a circumference of a circle, resulting in a 6 dB bandwidth of at least 11 per cent.

2. The method of producing the circularly polarized wideband traveling wave from the compact, lightweight, planar microstrip antenna for a mobile communications platform, as recited in claim 1, wherein the step of propagating a traveling wave comprises propagating a traveling wave along said first and second conductive patches disposed on said lower dielectric layer and said coupling patch disposed on said upper dielectric layer, wherein the first, second and coupling patches are located along at least a portion of the circumference of the circle.

3. The method of producing the circularly polarized wideband traveling wave from the compact, lightweight, planar microstrip antenna for a mobile communications platform, as recited claim 2, wherein the step of shifting the phase comprises propagating the traveling wave along the first, second and coupling patches one quarter of the circumference of the circle, which is a distance of about one quarter of the wavelength of the leaky wave radiation propagating in the antenna.

4. The method of producing the circularly polarized wideband traveling wave from the compact, lightweight, planar microstrip antenna for a mobile communications platform, as recited in claim 3, further comprising the steps of:

forming said layers with a dielectric constant equal or less than 2.2; and exciting said microstrip by said single coaxial probe to produce said leaky wave radiation in a frequency range given by the formula:

$$f_c < f < \frac{f_c\sqrt{\varepsilon_r}}{\sqrt{\varepsilon_r - 1}}$$

where said $\epsilon_r$ is a dielectric constant of said lower dielectric layer, said $f_C$ is a cutoff frequency and said f is an operating frequency.

5. The method of producing the circularly polarized wideband traveling wave from the compact, lightweight, planar microstrip antenna for a mobile communications platform, as recited in claim 3, wherein:

said layers having a dielectric constant of about 1.1; and a CP bandwidth of at least 20 per cent.

6. The method of producing a circularly polarized wideband traveling wave from a compact, lightweight, planar microstrip antenna for a mobile communications platform, as recited in claim 1, wherein the step of exciting said microstrip to produce leaky wave radiation further comprises the step of preventing and suppressing radiation caused by surface mode excitations.

7. The method of producing a circularly polarized wideband traveling wave from a compact, lightweight, planar microstrip antenna for a mobile communications platform, as recited in claim 6, wherein the step of matching the input impedance further comprises the step of varying the widths and the locations of said first, second and conductive patches along the upper and lower dielectric layers of the microstrip until the input impedance of the antenna matches said leaky wave propagation mode of the radiation.

8. An article of manufacture for producing a circularly polarized wideband traveling wave for mobile communications platforms, further comprising:

a circularly polarized leaky-wave wide band traveling wave formed by:

producing leaky wave radiation; and circularly polarizing the leaky wave radiation with a compact, lightweight, planar circularly polarized wideband traveling wave microstrip antenna, further comprising:

a microstrip having an upper dielectric layer and a lower dielectric layer;

a first conductive patch and a second conductive patch, each being circularly curved and located on said lower dielectric layer, are separated by a gap;

a conductive ground plane is disposed on a planar surface of said lower dielectric layer;

a coupling patch, being composed of a conductive material, circularly curved and positioned on said upper dielectric layer, covers said gap;

a single coaxial feed probe being coupled to said first patch and said lower dielectric layer, said single coaxial probe excites said microstrip to produce a leaky wave radiation;

wherein the leaky wave radiation is circularly polarized by:

producing two perpendicular, radiating fields; and shifting the phase of at least one of the fields until the two fields are 90 degrees out of phase;

said upper dielectric layer and said lower dielectric layer controlling an antenna radiation level and an input impedance of said antenna, causing said input impedance to match a leaky wave propagation mode of said leaky wave radiation;

said first, second and coupling patches being positioned on said layers causing an alteration of a field strength at said single coaxial probe resulting in said field strength matching said input impedance at said single coaxial probe;

said first, second and coupling patches being configured and aligned to circularly polarize the leaky wave radiation when a traveling wave propagates along said first, second and coupling patches;

wherein the two perpendicular, radiating fields are produced by propagating a traveling wave from one of the radiating fields along one quarter of a circumference of a circle, resulting in a 6 dB bandwidth of at least 11 per cent.

9. The article of manufacture for producing a circularly polarized wideband traveling wave for mobile communications platforms, as recited in claim 8, wherein the traveling wave propagates along one quarter of the circumference by propagating along said first and second conductive patches disposed on said lower dielectric layer and said coupling patch disposed on said upper dielectric layer, wherein the first, second and coupling patches are located along at least a portion of the circumference of the circle.

10. The article of manufacture for producing a circularly polarized wideband traveling wave for mobile communications platforms, as recited in claim 9, wherein the phase is shifted by propagating the traveling wave along the first, second and coupling patches one quarter of the circumference of the circle, which is a distance of approximately one quarter of the wavelength of the leaky wave radiation propagating in the antenna.

11. The article of manufacture for producing a circularly polarized, wideband traveling wave for mobile communications platforms, as recited in claim 10, further comprising said upper and lower dielectric layers having a dielectric constant equal or less than 2.2.

12. The article of manufacture for producing a circularly polarized wideband traveling wave for mobile communications platforms, as recited in claim 10, further comprising:

said upper and lower dielectric layers having a dielectric constant of about 1.1; and a CP bandwidth of at least 20 per cent.

13. The article of manufacture for producing a circularly polarized wideband traveling wave for mobile communications platforms, as recited in claim 8, wherein the leaky wave radiation is produced by:

matching the input impedance of the antenna to the leaky wave propagation mode of the radiation; and preventing and suppressing radiation caused by surface mode excitations.

14. A compact, lightweight, planar circularly polarized leaky-wave wideband traveling wave microstrip antenna for mobile communications platforms, comprising:

a microstrip having an upper dielectric layer and a lower dielectric layer, said upper and lower dielectric layers being rectangular;

a first conductive patch and a second conductive patch, each being circularly curved and located on said lower dielectric layer, are separated by a gap;

a conductive ground plane is disposed on a planar surface of said lower dielectric layer;

a coupling patch, being composed of a conductive material, circularly curved and positioned on said upper dielectric layer, covers said gap;

a single coaxial feed probe being coupled to said first patch and said lower dielectric layer, said single coaxial probe excites said microstrip to produce a leaky wave radiation;

said upper dielectric layer and said lower dielectric layer control an antenna radiation level and an input impedance of said antenna, causing said input impedance to match a leaky wave propagation mode of said leaky wave radiation;

said first, second and coupling patches being positioned on said layers cause an alteration of a field strength at said single coaxial probe resulting in said field strength matching said input impedance at said single coaxial probe; and said first, second and coupling patches being configured and aligned to circularly polarize the leaky wave radiation when a traveling wave propagates along said first, second and coupling patches resulting in a 6 dB bandwidth of at least 11 per cent.

15. The compact, lightweight, planar circularly polarized leaky-wave wideband traveling wave microstrip antenna for mobile communications platforms, as recited in claim 14, further comprising the single coaxial feed probe being electro-magnetically coupled to said first patch in a direction perpendicular to a direction of propagation across said lower dielectric layer.

16. The compact, lightweight, planar circularly polarized leaky-wave wideband traveling wave microstrip antenna for mobile communications platforms, as recited in claim 15, further comprising:

said first conductive patch and said second conductive patch provide a first radiating source;

said coupling patch provides a second radiating source;

wherein the two sources produce perpendicular fields of approximately equal magnitudes; and said single coaxial probe excites said microstrip to produce said leaky wave radiation in a frequency range given by the formula:

$$f_c < f < \frac{f_c\sqrt{\varepsilon_r}}{\sqrt{\varepsilon_r - 1}}$$

where said $\epsilon_r$ is a dielectric constant of said lower dielectric layer, said $f_C$ is a cutoff frequency and said f is an operating frequency.

17. The compact, lightweight, planar circularly polarized leaky-wave wideband traveling wave microstrip antenna for mobile communications platforms, as recited in claim 16, wherein the fields of the two radiating sources are 90 degrees out of phase.

18. The compact, lightweight, planar circularly polarized leaky-wave wideband traveling wave microstrip antenna for mobile communications platforms, as recited in claim 17, further comprising:

the two radiating sources being configured and aligned to circularly polarize the leaky wave radiation;

the fields produced by the two radiating sources become perpendicular to each other by propagating a traveling wave from the first radiating source along the circularly curved shape of the first, second and coupling patches by 90 degrees of the circumference of a circle.

19. The compact, lightweight, planar circularly polarized leaky-wave wideband traveling wave microstrip antenna for mobile communications platforms, as recited in claim 18, wherein a distance of 90 degrees along the circularly curved shape of the patches equals approximately one quarter of the wavelength of the radiation while the radiation is propagating in the antenna, so that the phase of the first radiating source is shifted by 90 degrees.

20. The compact, lightweight, planar circularly polarized leaky-wave wideband traveling wave microstrip antenna for mobile communications platforms, as recited in claim 19, further comprising:

said first patch, being circularly curved and having a first radius;

said second patch, being circularly curved and having a second radius which is larger than the first radius, so that said gap is formed on the surface of the lower dielectric layer in between the first and second conductive patches;

said coupling patch, being circularly curved and located on the upper dielectric layer, above the gap on the lower dielectric layer, so that the coupling patch is electromagnetically coupled to the lower dielectric layer;

wherein a difference between an impedance of a plurality of surface modes and a leaky wave impedance suppresses said plurality of surface modes.

21. The compact, lightweight, planar circularly polarized leaky-wave wideband traveling wave microstrip antenna for mobile communications platforms, as recited in claim 20, further comprising:

said upper and lower dielectric layers having a dielectric constant of about 1.1; and a CP bandwidth of at least 20 per cent.

22. The compact, lightweight, planar circularly polarized leaky-wave wideband traveling wave microstrip antenna for mobile communications platforms, as recited in claim 20, wherein the circular shape of the upper and lower dielectric layers is at least a quarter circle.

* * * * *